United States Patent [19]

Wells et al.

[11] 4,014,205

[45] Mar. 29, 1977

[54] ELECTRONIC CLOCK REGULATOR

[76] Inventors: Larry L. Wells, 7841 Austin Road, Jacksonville, Fla. 32210; William G. Finkenbiner, 2137 W. Alabama, Houston, Tex. 77098

[22] Filed: May 17, 1976

[21] Appl. No.: 686,836

[52] U.S. Cl. ..... 73/6

[51] Int. Cl.[2] ..... G04D 7/12

[58] Field of Search ..... 73/6

[56] References Cited

UNITED STATES PATENTS

| | | | |
|---|---|---|---|
| 3,811,314 | 5/1974 | Anouchi | 73/6 |
| 3,939,689 | 2/1976 | Desarzens | 73/6 |

*Primary Examiner*—S. Clement Swisher
*Attorney, Agent, or Firm*—Bill B. Berryhill

[57] ABSTRACT

An illustrative embodiment of the present invention includes an apparatus for electronically timing the period of mechanical or electromechanical clocks. A continuously variable preselected ideal clock period is digitally entered into the apparatus. The regulator is acoustically coupled to the clock being regulated. The time between electronically processed clock ticks is accurately measured by a precision counter and frequency standard and compared against the ideal period. Any deviation from the ideal period is displayed as an error so that appropriate corrective action may be taken by the operator.

10 Claims, 2 Drawing Figures

ELECTRONIC CLOCK REGULATOR

BACKGROUND OF THE INVENTION

This invention pertains to electronic clock regulating apparatus and more particularly to such apparatus of the time interval rate meter type.

In the prior art, two general methods have been used for regulating clocks and watches. The first such method involves counting the number of clock ticks or clock pulses generated by the clock for a specified length of time which may be termed "the measurement interval". The second such method has involved measuring very accurately the time interval elapsing between clock ticks or pulses from the clock being regulating.

The first of the above methods give a count which is directly proportional to the clock rate. However, where this rate is relatively slow, a very long sampling time interval may be needed to obtain the desired accuracy for regulation of the clock. In the second method, the count which is generated is inversely proportional to the rate of the clock being regulated. This technique, however, has the additional advantage that a high degree of accuracy may be obtained over a relatively short sampling time or measurement time interval.

Prior art commercial clock and watch regulating devices such as that shown in U.S. Pat. No. 3,811,314, have generally employed fixed predetermined sampling time intervals which are related to the gear train ratios commonly used in certain types of commercial clocks and watches. For example, in conventional clocks and watches, the mainly used frequencies are 3,600; 16,000; 17,280; 18,000; 19,200; 19,800; 36,000; and 72,000 beats per hour. In the case of certain tuning fork type watches, frequencies such as 360 cycles per second and 200 and 300 cycles per second are also commonly used. The measurement or sampling time interval (which may be termed the "ideal period") in these type prior art clock regulators has been limited to periods specified by these particular commercially used gear train or tuning fork frequencies.

In dealing with antigue clocks and watches, however, commonly used present day commercial gear ratios or tuning fork frequencies may not be commonly encountered. A need has arisen, therefore, for a clock regulator which is capable of determining the error of such a clock or watch from an idealized period and which may be continuously varied over a relatively wide range of such idealized periods or time intervals. The present invention has much more flexibility than prior art devices of the type in the aforementioned patent, in that it provides a time interval rate meter which is capable of accurately measuring the time interval between the clock ticks or clock pulses of a clock being regulated. The regulator of the present invention displays in a desired format the error from the idealized period which may be varied over a range of $10^7$. The present invention thus has a much wider range of applicability than prior art devices. Similarly, the present invention by employing totally electronic and digital logic avoids many of the cumbersome and mechanically troublesome features present in prior art electromechanical clock regulators.

The clock regulator of the present invention permits measurement of a clock's error to within a few one thousandths of a second to be accomplished within only a few minutes of adjustment interval. Roughing in adjustments on a clock are performed very quickly with this instrument because gross errors in time keeping are revealed in just four or five swings of the clock pendulum or balance wheel. Utilizing the clock regulator of the present invention, regulation of a clock to within one minute per day usually occupies less than five minutes of a technician's time. Regulation to within ten seconds per day can be accomplished by making test runs of two minutes duration. Higher degrees of accuracy may be obtained by employing longer test periods. Utilizing the clock regulator of the present invention, other factors concerning a clock's operation may be discerned by the skilled technician. Variations of the clock's rate are immediately revealed by the regulator and can be correlated with clock defects such as irregular or out of round wheels, binding of a wheel and defects due to variation of main spring tension in the clock. Regulation of a clock by use of the present invention is performed by presetting the regulator to the idealized cyclic time period which is produced by the mechanical clock to be regulated and which would result in extremely accurate timekeeping. This presetable cyclic time period or idealized time period is continuously adjustable in the clock regulator of the present invention from 0.000001 seconds to 9.999999 seconds in one microsecond steps. The regulator is coupled to the clock by a contact microphone pickup device and is then synchronized to the clock tick rate. The out-of-adjustment or non-ideal characteristics of the clock being regulated results in a gradual loss of this synchronism. This loss of synchronism is measured by the regulator circuitry which displays this drift or error on a display means calibrated in convenient units. The clock technician may then use the measured drift to estimate or calculate necessary corrections to the mechanical clock. When these corrections are performed, another test using the regulator is initiated. This procedure may be repeated until a desired degree of accuracy is achieved.

The present invention may best be understood by reference to the following detailed description thereof when taken in conjunction with the appended drawings.

DESCRIPTION OF THE PREFERRED EMBODIMENT

Figure 1:
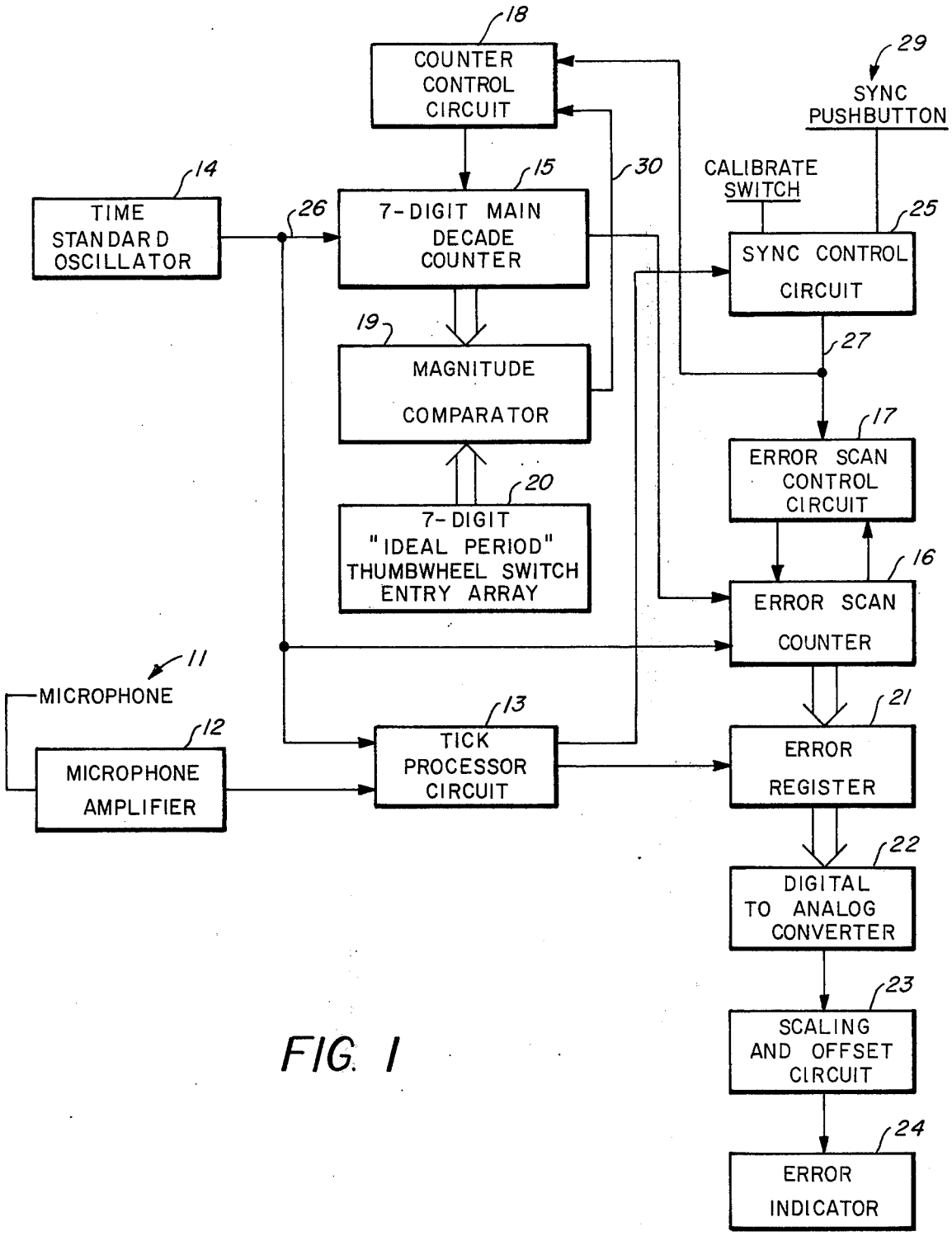
FIG. 1 is a schematic system drawing showing the overall operating characteristics of the clock regulator system of the present invention.

Referring initially to FIG. 1, the overall layout of a system of clock regulation according to the concepts of the present invention is illustrated schematically. Basically, the system operates to compare the ticks of a clock or watch being regulated by acoustically coupling said watch or clock through a microphone 11 against an idealized period for said watch or clock which is entered manually into the system through a digital entry device 20. The timing comparison is governed by a precision time standard oscillator 14. The ticking of the watch or clock to be regulated is amplified in a microphone amplifier circuit 12 and electronically processed in a tick processor circuit 13 in a manner to be described in more detail subsequently. The operation of the system comparison circuitry for regulating the clock or watch is synchronized by a synch control circuit 25 which causes the processed tick from the mechanical watch or clock being regulated (and which is output from the tick processing circuit 13) to be exactly synchronized with a timing pulse generated by the time standard oscillator 14. The manner in which synch-control circuit 25 accomplishes this will be described in more detail subsequently.

The operating technician enters an idealized period for the watch or clock under calibration by means of a digital entry device 20. This may comprise, for example, a battery of thumb-wheel switches, each of which has ten decimal number positions and which produces a binary coded decimal output corresponding to the selected idealized time period for a given clock. Each switch of the seven-digit entry array may also provide a visual display of the selected ideal period value. In this seven-digit display, a decimal point is displayed between the first and second digits. The range of this entry device may thus vary between 0.000001 seconds and 9.999999 seconds continuously in one microsecond steps.

The basic timing accuracy of the clock regulator of the present invention is established by a precision crystal oscillator and processing circuitry, which will be described in more detail subsequently and comprising the time standard oscillator 14 of FIG. 1. In a preferred embodiment of the invention, for example, a quartz crystal having a frequency of 4 megahertz is utilized which corresponds to a timekeeping accuracy of better than one-half second per day. Of course, more accurate time standards may be utilized if higher accuracy is desired. However, for practical purposes in calibrating mechanical clocks, such a quartz crystal oscillator having a 0.00035 percent accuracy is usually considered adequate. The four megahertz output of the quartz crystal oscillator circuit of the time standard oscillator 14 is frequency divided down to produce one megahertz output pulses on timing signal line 26.

These timing signal pulses on line 26 are applied to a seven-digit main decade counting circuit 15 and also to an eight binary digit (bit) error scan counter 16. The functioning of the seven-digit main counter 15 is controlled by a counter control circuit 18 which operates in a manner which will be described in more detail subsequently. It will suffice in the initial description of the system merely to state that the counter control circuit 18 controls the operation of the seven-digit main counter 15 in response to output signals from a magnitude comparator 19 and also in response to output signals from the synchronization control circuit 25.

The error scan counting circuit 16 is operated under control of the error scan control circuit 17. It will be recalled that one megahertz output pulses from the time standard oscillator are supplied via line 26 to the error scan counter 16. Synchronization control signals are supplied to the error scan control circuit 17 via line 27. The contents of the error scan counter are sampled at regular measurement intervals by the error register 21. This sampling, however, is controlled by certain validation signals, to be further described subsequently, furnished on line 28 from the tick processing circuit 13.

Basically, the error scan counter circuit 16 and error register 21 are utilized to display any drift or error from the ideal clock period entered into the digital entry device 20 provided certain conditions are met. Output error signals from the error register 21 are supplied to a display device which may be either digital or analog in nature, but which in the case of the preferred embodiment illustrated in FIG. 1 comprises an analog display system having a digital to analog converter 22, a scaling and offset circuit 23 and a meter display means (labeled error indicator) 24.

In operation, the system of FIG. 1 is used as follows: The ON/OFF calibrate switch 30 is put in the "ON" position. The microphone 11 is attached to the clock or watch to be regulated by the operator. The ideal clock period is entered via the digital entry device 20. The operator then depresses the synch-push-button 29 which as has previously been mentioned, causes the synchronization control circuit to lock in synchronization the processed ticks from tick-processing circuit 13 to the time standard signals generated by the time standard oscillator 14. The synchronization control circuit 25 then enables the counter control circuit 18 to enable the seven-digit main counter to commence counting standard timing signals on line 26 from the time standard oscillator 14. The magnitude comparator 19 constantly compares the contents of the seven-digit main counter 15 with the contents of the digital entry device 20. Simultaneously with this, the synchronization control circuit 25 signals the error-scan control circuit 17 to enable the error-scan counter 16 to begin counting timing pulses from the time standard oscillator 14 which are provided on line 26. The error scan period (or zone) generated by error-scan control circuit 17 actually comprises a sub-interval or zone of the main counting sequence. Thus, when the magnitude comparator 19 reaches a condition such that the count of timing pulses contained in the seven-digit main counter 15 is equal to or greater than the idealized period entered via the digital entry device 20, an output signal from the comparator 19 is supplied via line 30 to the counter control circuit 18 to stop the counting operation. At this point, providing synchronization has been met and maintained during the operation (as indicated by synchronization signals from synchronization control circuit 25 provided on line 27 to the error-scan control circuit 17) the error-scan counter 21 will contain the number of precision timing pulses occurring during the last sub-interval or zone of the measurement interval. This number will be indicative of the drift or deviation from the ideal period of the mechanical watch or clock which is being regulated. This number is in turn displayed on the display system previously described.

Figure 2:
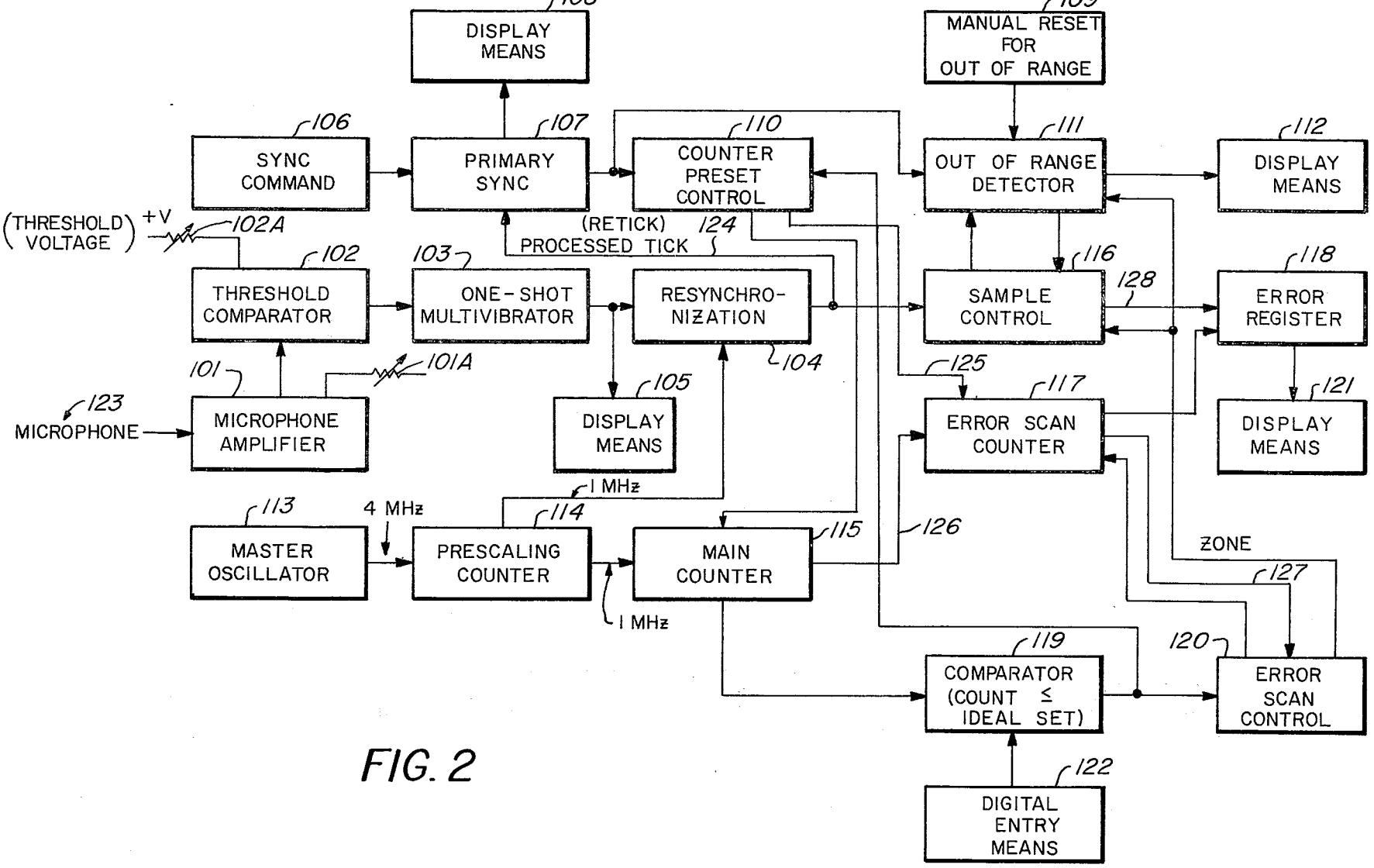
FIG. 2 is a logic block diagram illustrating in more detail the clock regulator system of the present invention.

Referring now to FIG. 2, a logic circuit diagram of a clock regulation system according to the concepts discussed with respect to FIG. 1 is illustrated in more detail but still schematically. In the regulator of FIG. 2, coupling to the clock is accomplished by a contact microphone 123 which is clipped or otherwise mechanically fastened onto the clock movement to detect the sound generated by the escapement mechanism of the clock being regulated. This sound, which in audible terms is the ticking of the clock, comprises a burst of audio frequency noise having a rather irregular shaped voltage envelope. The rise time of this envelope is adequate to resolve the time of the escapement noise to within 2 milliseconds even in the worst of clocks. The time uncertainty of the clock tick detection is non-cumulative and generates an error which becomes less significant as the length of the regulation test time increases. For example, if a two-minute test time is used, which is typical for intermediate stages of clock regulation, two milliseconds represents 16.6 parts per million or 1.44 seconds per day of error generated due to the resolution of the clock escapement noise. The contribution of this error is inversely proportional to the length of the test and in the final stages of regulation, becomes negligible.

The noise burst detected by the microphone is amplified in a microphone amplifier 101 having a variable gain control potentiometer 101*a*. The microphone amplifier 101 amplifies the noise burst to a level of several volts peak to peak. This amplified noise burst is delivered to one terminal of an analog threshold comparator 102. The other terminal of the comparator 102 is supplied with a variable threshold voltage controlled by a variable potentiometer 102*a*. In this manner, the operator may adjust the sensitivity of the regulator to accommodate noisy clocks as well as relatively quiet clocks. If the amplified microphone voltage does not exceed the threshold level, the escapement noise movement generated in the clock is simply ignored by the comparator 102 and no output results. When the threshold is exceeded, an output signal from the threshold comparator 102 is produced.

The output of the comparator 102 is a logic level signal comprising a burst of logic pulses for each input noise burst supplied to it. This burst of pulses is applied to a retriggerable, monostable multi-vibrator 103, which consolidates the burst into a single logic pulse. The time duration or period of the output of the monostable, multi-vibrator 103 is nominally approximately 50 milliseconds. This time constant is, of course, subject to temperature variation, but as only the leading edge of this level is interpretted as significant, the variability of its period is of no consequence.

The output of the multivibrator 103 is supplied to a display means 105 as a means of informing the operator that the electronic circuitry has recognized the escapement sound as a clock tick. The display means 105 may comprise, for example, a light emitting diode which emits light for the duration of the multivibrator output pulse, nominally some 50 milliseconds.

Typically the output of the multi-vibrator 103 is not synchronous with that of the timing pulses supplied by the master oscillator 113 and prescaling (divide by four) counter 114 due to the unpredictableness on a short time scale of the occurrence of a clock tick. The output of the one-shot multi-vibrator 103 (leading edge) is therefore supplied to a resynchronization circuit 104. The resynchronization circuit 104 recognizes the occurrence of the leading edge of a pulse from one shot multi-vibrator 103 but delays the occurrence of an output pulse representing this leading edge until the receipt of the next one megahertz timing pulse from the master oscillator 113 and prescaler 114. This delay is insignificant with respect to the timing of the regulator as it amounts to a maximum of slightly less than one microsecond due to the 1 megahertz frequency of the output of prescaling counter 114. When the resynchronization (or presynchronization) has occurred, the resynchronization circuit 104 provides a precise single pulse of one microsecond duration which may be termed a "processed tick pulse" or "retick pulse" on its output line 124. This one microsecond precision pulse generated by the resynchronization circuit 104 on line 124 may be interpreted as the actual time of occurrence of the tick of the mechanical clock.

At the initiation of a regulation test, the operator informs the electronic circuitry that synchronization of the system with the mechanical clock ticks is required. A synchronization command signal is initiated by a synchronization command circuit 106 for this purposes. This may comprise, for example, a pushbutton which is depressed by the operator or in an automatic clock regulating system, this could comprise a signal received from a data acquisition module. In any case, the synchronization command signal generated in synch-command module 106 is supplied to a primary synchronization circuit 107. Upon receipt of a synchronization command, the primary synchronization circuit 107 remembers this command until a clock tick is received via line 124. At this time, any previous test run which was underway is stopped and a signal is supplied to counter preset control circuit 110 which causes the main counter 115 to be stopped and reset to a count which corresponds to zero error. This same signal is also supplied on line 125 and causes the error scan counter module 117 to be stopped and locked at a count representing a zero error. The counters are thus stopped and remain stopped until the next retick pulse occurs on line 124 when they are allowed to resume their counting sequences. The synchronization occurrence is also signalled to the operator by an output pulse provided to a display means 108 which may comprise, for example, a light emitting diode which is driven to emit light upon the occurrence of synchronization by the primary synch-circuit 107. Since both the main counter 115 and the error scan counter 117 are locked in a zero-error position upon the occurrence of a synch-command generated by the synch command module 106, the initiation of a measurement sequence starts these counters in synchronization with the processed or retick signal on line 124 on the next occurrence of a tick from the mechanical clock being regulated.

It will be recalled that the digital entry means 122 output is connected to one input of the comparator circuit 119 while the main counter 115 contents are connected to the opposite input of the digital comparator 119. If the numerical value in the main counter 115 is equal to or greater than the value supplied by the input switches 122, the magnitude comparator 119 supplies a signal to the error scan control circuit 120 which causes both the main counter 115 and the error scan counter 117 to be reset to a count of "1" upon the next receipt of a one megahertz timing pulse from the master oscillator 113 prescaler 114 combination. Upon receipt of this pulse, the error scan control circuit 120 generates a logic level voltage termed "zone". This logic term is initiated by the reset of the main counter 115 and is terminated whenever the error scan counter 117 reaches its terminal count of 256 (corresponding to eight binary digits or bits). Thus, the "zone" logic level is 255 milliseconds in duration and is initiated whenever the main counter 115 is reset to a count of "1".

Retick pulses which occur during the existence of the logic level zone are interpreted as clock ticks from the mechanical clocks being regulated. Ticks which occur outside the logic level "zone" duration are ignored.

The error scan counter 117 comprises a synchronous eight-bit binary counter which runs in parallel with the main counter chain 115. The error-scan counter 117 however is incremented in one-millisecond intervals under the control of the terminal count output of the third decade of the main counter chain via line 126. This binary counter 117 is reset to zero by the same signal which resets the main counter chain 115. This counter, therefore, counts one millisecond interval signals until a count of 255 is reached. The counter 117 locks at this count and terminates the "zone" logic level signal by transmitting a termination signal on line 127 to the error scan control circuit 120 in the process.

The occurrence of a retick pulse on line 124 during the existence of a "zone" logic level causes the state of the binary counter 117 to be copied into an eight-bit error register 118. This register may be termed the "output" register and its contents at any time are the binary value of the number of milliseconds since the last main counter reset. If the retick pulse occurred with zero temporal error (i.e. since the reset occurs with zero temporal error only when the comparator ideal period is exactly equal to the timed signal in the main counter 115) the value contained in the error register 118 will be the number $127_{10}$. The contents of this error register 118 are continuously displayed by display means 121 which may be of the type previously described with respect to FIG. 1 or may represent other types of digital display means if desired.

It is possible that for some reason such as the contact microphone 123 becoming disassociated from the clock being regulated or for circuit failure that during a regulation process, retick pulses may cease being generated. An out of range detector circuit 111 and a sample control circuit 116 are provided in this case to prevent the contents of the error register from being validly displayed as a regulation signal by the display means 121. To this end, the logic level "zone" signals are supplied to the out of range detector 111 and the sample control circuit 116. Whenever the leading edge of a "zone" logic level voltage occurs, the out of range detector 111 comprising a ripple counter circuit is incremented by one count. If a retick pulse occurs on line 124 during a "zone" logic level existence, the sample control circuit 116 resets the out of range counter 111 to zero. If the out of range counter 111 should reach a count of four without receiving a reset pulse from the sample control circuit 116, the retick signals are locked out from reaching the error register 118 by a signal provided by the sample control circuit 116 on a line 128. An out of range indicator display means 112 is also turned on at this time. The lock-out of the retick pulses prevents further updating of the output error register 118 and the display out of range indicator 112 informs the operator that the clock under test has either drifted out of range or that some circuit failure or loss of microphone contact has occurred.

In this scheme, as long as the clock is producing ticks within the error range of the regulator, the out of range counter 111 is prevented from reaching the count of four because each "zone" retick pulse resets the counter 111 to zero through the action of the sample control circuit 116.

A manual reset for out of range override is provided as indicated at block 109 by a button which may be depressed according to operator judgment if he thinks that the out of range indication has been caused by some temporary malfunction which may be overriden without reinitiating the test. In any event, the appearance of an out of range indicator 112 signal calls for some judgment intervention by the operator of the regulation system.

Summarizing the operation of the system of FIG. 2, an idealized period which is entered by the operator is compared against the actual period as determined by the frequency of occurrence of clock ticks timed by precision counter in main counter chain 115. Any difference from the ideal period appears as an error count in error scan counter 117 which is displayed in error register 118 and its associated display circuitry. The operator may then take appropriate action to correct the mechanical clock on the basis of the error displayed by error display means 121 in the measurement sequence reinitiated. During the measurement sequence, the electronic circuitry of the clock regulator and the electronically processed mechanical ticking of the clock are synchronized by appropriate circuitry to provide a very accurate measurement of any error from the ideal period.

The fact that the ideal period may be specified and incremented in one microsecond steps continuously for any duration from microsecond to ten seconds makes the clock regulator of the present invention far more versatile and utilitarian than previous clock regulators which are constrained to operate with only certain preselected sets of gear train ratios. Thus a significant improvement in the state of the art of clock regulation is represented by the clock regulator of the present invention.

The foregoing descriptions may make other alternative embodiments of the present invention apparent to those skilled in the art. The aim of the appended claims is therefore to cover all such changes and modifications as fall within the true spirit and scope of the invention.

We claim:

1. Apparatus for regulating the performance of mechanical or electromechanical clocks, comprising:

precision time pulse generating means;

means for preselecting a continuously variable ideal period of the clock being regulated and for providing a digital count representation thereof;

means for providing electrical pulse representations of acoustic ticks made by the clock being regulated;

means responsive to said acoustic tick pulses for counting said precision timing pulses to measure with precision the number of such timing pulses occurring between said acoustic tick pulses to generate a count measurement of the actual period of the clock being regulated; and means for comparing said count measurement with the count representation of said preselected ideal period to derive an error count measurement as a function of any time discrepancy between the actual measured period and the preselected ideal period of the clock being regulated.

2. The apparatus of claim 1 and further including:

means for synchronizing said pulse representations of said acoustical ticks and said precision timing pulses.

3. The apparatus of claim 2 and further including:

means for initially synchronizing and zeroing said counting means with said pulse representation of said acoustical ticks.

4. The apparatus of claim 1 wherein said means for producing said acoustical tick representation pulses includes acoustic transducer means coupling the mechanical clock ticks of the clock being regulated to the regulator apparatus by providing electrical representations thereof and selectable threshold comparison means for rejecting such representations falling below a selectable voltage level.

5. The apparatus of claim 4 and further comprising means for providing a precision electrical pulse of predetermined duration and wave shape corresponding to the onset of an initial electrical representation of a mechanical tick of the clock being regulated.

6. The apparatus of claim 1 and further including means for displaying said error count signal.

7. The apparatus of claim 1 and further including means for determining if said tick pulses occur within the measurement range of the apparatus and for signalling the operator if said tick pulses fail to occur within the measurement range of the apparatus from the selected ideal period.

8. The apparatus of claim 7 wherein said determining means also includes means for preventing the generation of a spurious error count signal upon such occurrence.

9. The apparatus of claim 1 wherein said means for preselecting an ideal period comprises a presetable digital array which is continuously variable from 0.000001 seconds to 9.999999 seconds in 1 microsecond steps.

10. The apparatus of claim 9 wherein said precision time pulse generating means operates at a frequency of at least 1 megahertz.

* * * * *